United States Patent [19]

Schreiber

[11] 3,984,061

[45] Oct. 5, 1976

[54] HIGH-SPEED YARN TRAVERSE APPARATUS

[75] Inventor: Manfred Schreiber, Horgen, Switzerland

[73] Assignee: Maschinenfabrik Schweiter AG, Horgen, Switzerland

[22] Filed: July 3, 1975

[21] Appl. No.: 592,747

[30] Foreign Application Priority Data

Aug. 19, 1974 Switzerland ..... 11274/74

[52] U.S. Cl. ..... 242/43 R; 184/6.16

[51] Int. Cl.[2] ..... B65H 54/28

[58] Field of Search ..... 242/43 R, 43.1, 158.3, 242/158.5; 74/56, 57, 58, 59; 184/6.12, 6.16, 6.17, 6.27, 7 A, 10, 11 R, 11 A, 11 B, 11 C, 11 D, 13

[56] References Cited

UNITED STATES PATENTS

| | | | |
|---|---|---|---|
| 1,381,516 | 6/1921 | Strickland | 184/6.27 |
| 1,569,404 | 1/1926 | Smith | 184/6.27 |
| 2,676,671 | 4/1954 | Schmitter | 184/11 R |
| 3,373,949 | 3/1968 | Swallow | 242/43 R |
| 3,401,894 | 9/1968 | Campbell, Jr. | 242/43 R |
| 3,529,698 | 9/1970 | Nelson | 184/6.12 |
| 3,891,154 | 6/1975 | Dietiker | 242/43 R |

FOREIGN PATENTS OR APPLICATIONS

| | | | |
|---|---|---|---|
| 802,430 | 10/1958 | United Kingdom | 242/158.3 |
| 1,163,721 | 9/1969 | United Kingdom | 242/43 R |

*Primary Examiner*—Stanley N. Gilreath
*Attorney, Agent, or Firm*—Flynn and Frishauf

[57] ABSTRACT

To prevent splatter of oil from a traverse spiral drum upon rapid rotation of the drum in high-speed spooling machines, an oil retention plate is provided extending parallel to the axis of the drum and having an oil wiping edge engaging the surface thereof, the drum being located in advance — with respect to rotation of the drum — of the position of the slider block engaged in a spiral groove of the rotating drum to provide for the traverse movement, the plate being of sufficient width to block spray of oil centrifugally thrown off the surface of the drum upon rotation thereof, a bead of oil being formed at the engagement edge of the drum and the plate, the bead penetrating the spiral groove in the drum to provide, due to the rotation of the drum, lubrication of the lateral surfaces of the groove and hence lubrication for the slider block while preventing contact of lubricating oil with the yarn being spooled.

6 Claims, 3 Drawing Figures

Fig. 1
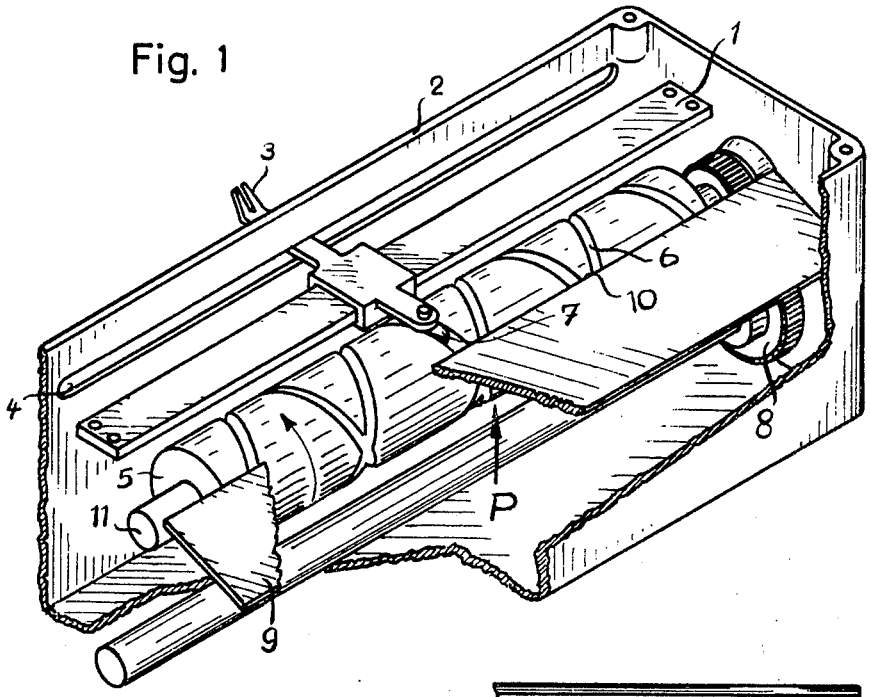
Fig. 3
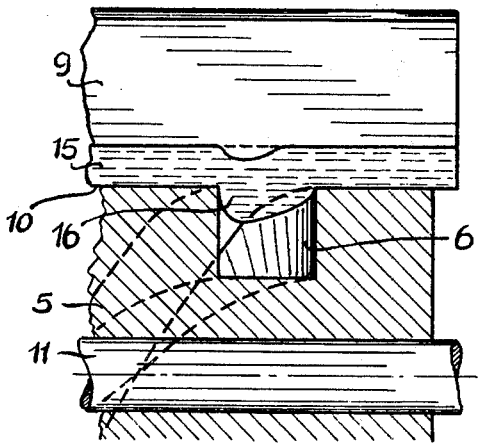
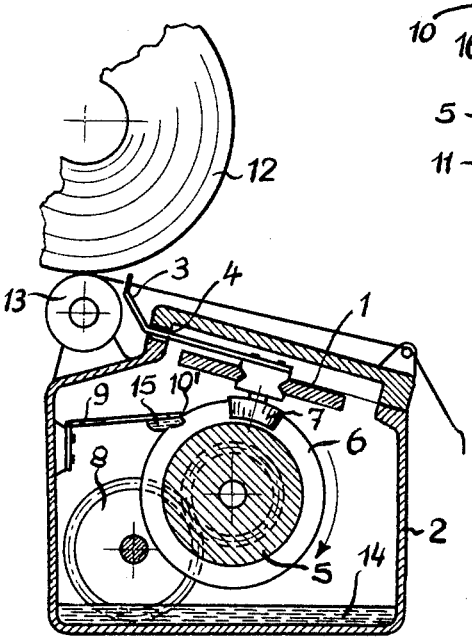
Fig. 2

HIGH-SPEED YARN TRAVERSE APPARATUS

Cross reference to related U.S. Pat. Nos. 3,764,090; 3,819,123; 3,891,154 (formerly Ser. No. 431,929).

The present invention relates to traverse control apparatus for spooling machines, and more particularly to such apparatus for high-speed yarn or thread spooling machines in which a yarn guide is reciprocated to guide yarn transversely of a wind-up spool.

Yarn traverse apparatus usually use a rotating drum in which a spiral groove is cut in a return pattern; a slider block engages in the groove and, upon rotation, is moved transversely, in axial direction, back and forth. The drum is usually located in a housing and to provide lubrication for the drum, for the engaging slider block and for the drive elements for the drum; the housing may be constructed in the form of an oil-retaining vessel, to have an oil level therein, in which portions of the mechanism can dip, for example the gears of a gear drive. The thread guide itself extends outside of the housing through a slit formed therein. The thread guide, of course, should be kept free from lubricant to prevent soiling of the thread or yarn.

Thread or yarn guides have to be so constructed that lubricant is not thrown out of the housing, due to rotation of the drum in a direction where it can escape through the thread guide slit, thus soiling the yarn, or the surrounding area. Sealing the thread guide slit against sprayed lubricant is a substantial problem. Reasonably satisfactory separation of lubricant from the thread and from the surrounding area could be obtained at operating speeds of the drum which permitted wind-up speeds of the yarn being spooled up to about 800 meters per second. Modern man-made fibers, particularly monofilamentary threads, can be spooled at speeds of over 4000 meters per second, however. At such spooling speeds, the traverse mechanism operates at speeds at which the previously used arrangements to prevent oil spray are no longer satisfactory. New problems arise as the traverse control drum rotates faster and faster, in that the groove and the engaging slider block must also be reliably lubricated; due to the high speed of rotation, it has been found that lubricant applied to the groove is thrown off centrifugally from the groove before the lubricant reaches the slider block; the slider block must, however, receive lubricant for proper operation within the groove.

It has previously been proposed (see Swiss Pat. No. 533,260, assigned to the assignee of the present application) to lubricate the slider block by means of radial bores formed in the body of the traverse drum and communicating with an axial bore through the axis therein; it has also been proposed to supply the slider block with lubricants from the outside (see Swiss Pat. No. 545,245, and corresponding U.S. Pat. No. 3,891,154, assigned to the assignee of the present application). These arrangements are satisfactory to supply the slider block and the groove with lubricant; the construction is, however, comparatively expensive and upon high-speed rotation of the traverse drum, lubricant is thrown off therefrom and reliable separation of sprayed lubricant from the thread guide, and penetration through the thread guide slit cannot be ensured.

It is an object of the present invention to provide a traverse apparatus for high-speed spooling machines in which the lubricant thrown off upon rotation of the traverse drum is prevented from penetrating through the thread guide slit in the housing, while still providing for reliable, adequate lubrication of the slider block and the groove. The usual lubricant being used is oil.

SUBJECT MATTER OF THE PRESENT INVENTION

Briefly, an oil retention plate is arranged within the housing of the traverse mechanism which extends at least approximately axially along the entire length of the spirally grooved traverse drum; the plate has a wiping edge located in advance — with respect to rotation of the drum — of the engagement position of the slider block in the reversely spiralled groove, the edge being shaped to form a bead of oil which is wiped into the groove, while the remainder of the plate reliably prevents spray of oil from the surface of the drum so that sprayed oil could escape through the thread guide slit.

The apparatus in accordance with the present invention permits the formation of a bead of oil at the circumference of the traverse drum, which bead of oil will be obtained by the presence of the plate adjacent the circumference thereof. This bead will extend over the positions at which, instantaneously, the grooves of the spirally grooved drum will occur. The bead will bulge slightly into the groove. Due to rotation of the drum, and due to the lateral, spiralling inclination of the groove, transverse forces will arise which tend to press the bead of oil against one of the lateral surfaces of the groove. This axially directed force causes constant tearing and deformation of this bead of oil, and thus deposition of the oil at the edge of the groove, which oil deposit is sufficient to effectively and reliably lubricate the groove in which the slider block is engaged, just beyond the edge of the plate, and hence the bead of oil. The plate can be so constructed that it extends from the traverse drum over to the oppositely located inner wall of the housing, so that any oil which is thrown off by centrifugal force upon rapid rotation of the drum will impinge on the underside of the plate. This oil supplies, at least in part, the bead of oil forming at the edge engaging the drum, the plate itself preventing however that oil which is centrifugally thrown can penetrate through the thread guide slit of the housing towards the outside thereof.

Best operating results are obtained when the edge adjacent the drum is so located that it is placed relatively closely to the engagement point of the slider block in the spiral groove of the traverse drum, and is so placed with respect to the drum that it includes an acute angle with a tangential plane at the contact line of the plate with the drum.

The arrangement in accordance with the present invention can be applied to various types of traverse control apparatus of current construction, for example to control apparatus in which the thread guide operates transversely on a guide rail, or to arrangements to wind pineapple yarn packages, for example as illustrated in Swiss Pat. No. 523,841, and corresponding U.S. Pat. No. 3,764,090, assigned to the assignee of the present application.

The invention will be described by way of example with reference to the accompanying drawings, wherein:

FIG. 1 is a schematic perspective view, partly in section and partly broken away, illustrating the thread guide apparatus having the oil retention plate, in accordance with the present invention, applied thereto;

FIG. 2 is a transverse schematic sectional view of a different embodiment of the present invention; and FIG. 3 is a fragmentary part sectional view looked at in the direction of the arrow P of FIG. 1 to a greatly enlarged scale.

The thread guide apparatus of FIG. 1 includes a housing 2 in which a transverse rail 1 is mounted, on which a thread guide 3 is slidably secured. The thread guide 3 extends through a slit 4 formed in housing 2, so that the free end thereof will reciprocate axially with respect to a traverse control drum 5. Traverse control drum 5 has a double spiral groove 6 therein in which a slider block 7 is engaged. Slider block 7 is connected to the thread guide 3. Upon rotation of the thread guide in counter-clockwise direction, that is, in the direction of the arrow P, block 7 engaged in grooves 6 will be reciprocated to and fro. The rotational speed of drum 5 and hence the traverse speed of thread guide 3 can be high.

The drum 5 is driven by means of a motor (not shown) connected to drive gears 8. The drive gears 8 are located in the housing. The housing is partially filled with oil 14 (FIG. 2), the gears dipping into the oil.

In accordance with the present invention, an oil retention plate 9 is secured to the forward side of the housing 2. The plate is so located within the housing with respect to the drum 5 that its forward edge 10 extends essentially over the entire axial length of the drum 5, parallel to its central shaft 11. The plate 9 lies on, or engages the circumference of the drum 5. The engagement line, looked at in the direction of rotation of the drum 5, is in advance of the engagement position of the slider block 7 in the grooves 6 of the roller 5. The engagement pressure of the edge 10 of plate 9 is low. A bead of oil 15 (FIG. 3) will form beneath plate 9.

The plate 9 is preferably made of sheet metal to which a strip or leaf of spring steel 10′ (FIG. 2) can be secured, for example by riveting, to form the wiping edge 10.

The wiping edge 10 is located close to the engagement position of the slider block 7, as is clearly apparent in FIG. 1. The plate 9 is inclined downwardly beyond the engagement line with the drum 5; it includes an acute angle with an imaginary tangential plane located at the junction of the engagement edge 10 and the circumference of traverse drum 5.

The arrangement of FIG. 2 is effectively identical to that of FIG. 1, except that the direction of rotation of the drum 5 has been reversed, and that plate 9 is located at the other side of the housing wall. FIG. 2 also shows the wind-up spool 12, and a drive roller 13 of a spooling unit of which the traverse mechanism is a part. The direction of rotation of drum 5 is indicated in FIG. 2, that is, in clockwise direction. Consequently, the oil retention plate 9 must be located at the back wall of the housing 2 to meet the requirement that the plate 9 is located in advance of the slider block 7, looked at in the direction of rotation of the traverse drum 5. The level of oil 14 is likewise shown in FIG. 2.

Operation, with reference also to FIG. 3: The traverse drum 5 operates with high circumferential speed. Oil which is deposited thereon, for example by the spray action of the gears 8, will be centrifugally thrown off the surface of drum 5. Oil which is thus thrown off the surface impinges at the bottom side of the plate 9, so that the portion of the housing above plate 9 will be free of oil fog, or of randomly sprayed oil. The relative arrangement of plate 9 with respect to the drum 5 does, however, transport a portion of the oil in the nip formed between the circumferential surface of drum 5 and the retention or wiping edge 10 of the retention plate 9, to collect there as a bead of oil 15 (FIGS. 2, 3). This bead of oil will be essentially uniform throughout the circumference of the drum 5 except in those regions where, at any instant of time, a groove 6 is located beneath the retention edge 10. As clearly seen in FIG. 3, the bead 15 will bulge outwardly and reach into the groove. Since the groove has axial pitch, that is, is a spiral groove, and due to the high speed of the drum 5, axially directed forces will act on the bulged-out portion 16 of the oil bead 15, pressing the bulged-out portion 16 against one of the lateral or flank surfaces of the groove 6. Oil will be constantly removed from the bulged-out portion, and deposit at that lateral or flank surface. The quantity of oil being removed from the bead is comparatively small and it has been found to be just sufficient in order to provide reliable lubrication for the slider block 7 operating within groove 6 just beyond the engagement edge 10, and hence just beyond the oil bead 15.

Yarn traverse mechanisms operating at very high speed can thus be constructed simply and with minimum modification of existing structures, and requiring only inexpensive, easily made structural elements.

Various changes and modifications may be made within the scope of the inventive concept.

I claim:

1. High-speed yarn traverse apparatus comprising a housing (2), a drum (5) having a double spiral groove (6) formed therein and located in the housing;

drive means (8) located in said housing, said housing forming a lubricating oil supply pan;

a slider block (7) located in the groove (6) and guided for reciprocating movement upon rotation of the drum (5), said housing being formed with an axially extending slit (4) therein, and a thread guide (3) connected to said slider block (7) extending through the slit (4) in the housing (2), characterized by an oil retention plate (9) extending parallel to the axis of the drum (5) and having an oil-wiping edge (10) engaging the surface of the drum, the plate being located in advance — with respect to rotation of the drum (5) — of the position of the slider block (7) in the groove (6), said plate being of sufficient width to block spray of oil being centrifugally thrown off the surface of the drum upon high-speed rotation thereof, said edge (10) damming oil therebeneath to form an oil bead (15) and shielding the portion of the housing above the plate against spray of oil being thrown off the surface of the drum by centrifugal force upon high-speed rotation of the drum.

2. Apparatus according to claim 1, wherein the wiping edge (10) of the plate engages the circumference of the drum (5) adjacent the engagement position of the slider block (7) in the groove (6) of the drum (5).

3. Apparatus according to claim 1, wherein the plate (9) engages the surface of the drum (5) at an acute angle with respect to a plane tangential to the drum (5) at the contact line between the plate (9) and the drum.

4. Apparatus according to claim 1, wherein the plate (9) is secured to an inner wall of the housing (2).

5. Apparatus according to claim 1, wherein the plate (9) is a sheet metal element and a leaf of spring steel (10') secured thereto and forming said wiping edge (10).

6. Apparatus according to claim 1, wherein the speed of rotation of the drum (5) and the angle of the plate (9) with respect to a plane tangential to the drum (5) at the contact line of said edge (10) are relatively arranged such that oil at the surface of the drum (5) will form a bead (15) beneath said plate and a penetrating bulge (16) in the region of the grooves (6) in the drum at the instantaneous position of a groove beneath the edge (10) of the plate.

* * * * *